US011718963B2

(12) United States Patent
Max-Theurer et al.

(10) Patent No.: US 11,718,963 B2
(45) Date of Patent: Aug. 8, 2023

(54) MACHINE AND METHOD FOR PROFILING AND DISTRIBUTING BALLAST OF A TRACK

(71) Applicant: Plasser & Theurer Export von Bahnbaumaschinen GmbH, Vienna (AT)

(72) Inventors: Johannes Max-Theurer, Vienna (AT); Manfred Brunninger, Altenberg (AT); Herbert Woergoetter, Engerwitzdorf (AT)

(73) Assignee: Plasser & Theurer Export von Bahnbaumaschinen GmbH, Vienna (AT)

( * ) Notice: Subject to any disclaimer, the term of this patent is extended or adjusted under 35 U.S.C. 154(b) by 361 days.

(21) Appl. No.: 16/482,773

(22) PCT Filed: Feb. 19, 2018

(86) PCT No.: PCT/EP2018/053973
§ 371 (c)(1),
(2) Date: Aug. 1, 2019

(87) PCT Pub. No.: WO2018/166755
PCT Pub. Date: Sep. 20, 2019

(65) Prior Publication Data

US 2020/0002896 A1 Jan. 2, 2020

(30) Foreign Application Priority Data

Mar. 17, 2017 (AT) ..... A 111/2017

(51) Int. Cl.
*E01B 27/10* (2006.01)
*E01B 27/02* (2006.01)

(52) U.S. Cl.
CPC ..... *E01B 27/107* (2013.01); *E01B 27/026* (2013.01)

(58) Field of Classification Search
CPC ..... E01B 27/026; E01B 27/021; E01B 27/02; E01B 27/023; E01B 27/022;
(Continued)

(56) References Cited

U.S. PATENT DOCUMENTS 1,918,348 A * 7/1933 Neddermeyer ..... E01B 27/08 171/16
2,697,887 A * 12/1954 Kershaw ..... E01B 27/04 37/104
(Continued)

FOREIGN PATENT DOCUMENTS

AT 287042 B 1/1971
AT 506078 A4 6/2009
(Continued)

OTHER PUBLICATIONS

International Search Report of PCT/EP2018/053973 dated May 24, 2018.
(Continued)

*Primary Examiner* — Jamie L McGowan
(74) *Attorney, Agent, or Firm* — Collard & Roe, P.C.

(57) ABSTRACT

A machine for profiling and distributing ballast of a track, having a frame supported on on-track undercarriages and lateral ballast pick-up devices which are adjustably fastened to the frame, wherein each ballast pick-up device is actuated by a conveyor drive. In this, the machine is designed in such a way that, in an inoperative position, the upper contours of the machine are arranged below a delimiting plane which slopes downward in the working direction and extends through a field of vision of a driver's cabin of a rail vehicle to be coupled to the machine at the rear end thereof. Thus,
(Continued)

the machine can be employed as a leading wagon of the rail vehicle, wherein sufficient visibility from the driver's cabin to the track is ensured.

11 Claims, 2 Drawing Sheets

(58) Field of Classification Search
CPC .... E01B 27/025; E01B 27/027; E01B 27/028; E01B 27/04; E01B 27/06; E01B 27/08; E01B 27/10; E01B 27/102; E01B 27/105; E01B 27/107; E01B 27/11
See application file for complete search history.

(56) References Cited

U.S. PATENT DOCUMENTS

| | | | | | |
|---|---|---|---|---|---|
| 3,612,184 | A * | 10/1971 | Plasser | E01B 27/023 | 171/16 |
| 3,872,929 | A * | 3/1975 | Teurer | E01B 27/02 | 171/16 |
| 4,245,703 | A * | 1/1981 | Theurer | E01B 27/10 | 171/16 |
| 4,538,687 | A * | 9/1985 | Theurer | E01B 27/105 | 171/16 |
| 4,635,664 | A * | 1/1987 | Theurer | E01B 27/10 | 134/127 |
| 4,707,935 | A | 11/1987 | Cicin-Sain | | |
| 5,052,132 | A * | 10/1991 | Theurer | E01B 27/022 | 37/104 |
| 5,094,018 | A * | 3/1992 | Theurer | E01B 27/02 | 37/104 |
| 5,289,648 | A | 3/1994 | Theurer et al. | | |
| 5,301,548 | A * | 4/1994 | Theurer | E01B 27/17 | 73/146 |
| 5,400,718 | A * | 3/1995 | Theurer | B61D 7/06 | 105/239 |
| 5,660,112 | A | 8/1997 | Theurer | | |
| 2010/0006307 | A1* | 1/2010 | Jager | E01B 27/08 | 171/16 |
| 2015/0057851 | A1* | 2/2015 | Turner | E01B 27/02 | 701/19 |
| 2016/0108582 | A1 | 4/2016 | Boyd et al. | | |
| 2019/0003130 | A1* | 1/2019 | Brunninger | E01B 27/08 | |

FOREIGN PATENT DOCUMENTS

| | | | | |
|---|---|---|---|---|
| CH | 550282 | A | 6/1974 | |
| CN | 1070706 | A | 4/1993 | |
| CN | 102575438 | A | 7/2012 | |
| CN | 202730560 | U | 2/2013 | |
| DE | 1085905 | B | 7/1960 | |
| EP | 0 092 886 | A1 | 11/1983 | |
| EP | 0 152 643 | A1 | 8/1985 | |
| EP | 3397956 | A1 | 11/1990 | |
| EP | 0 520 342 | A1 | 12/1992 | |
| EP | 0 732 451 | A1 | 9/1996 | |
| JP | 6177322 | B2 * | 8/2017 | E01B 27/023 |

OTHER PUBLICATIONS

English translation of Chinese Office Action in Chinese Application No. 201880014300.1 dated Jan. 6, 2021.
Chinese Office Action in Chinese Application No. 201880014300.1 dated Jan. 6, 2021.

* cited by examiner

MACHINE AND METHOD FOR PROFILING AND DISTRIBUTING BALLAST OF A TRACK

CROSS REFERENCE TO RELATED APPLICATIONS

This application is the National Stage of PCT/EP2018/053973 filed on Feb. 19, 2018, which claims priority under 35 U.S.C. § 119 of Austrian Application No. A 111/2017 filed on Mar. 17, 2017, the disclosure of which is incorporated by reference.

FIELD OF TECHNOLOGY

The invention relates to a machine for profiling and distributing ballast of a track, having a frame supported on on-track undercarriages and lateral ballast pick-up devices adjustably fastened to the frame, wherein each ballast pick-up device is actuated by a conveyor drive. The invention additionally relates to a corresponding method.

PRIOR ART

Machines of this type generally serve for distributing and profiling the bedding ballast following track tamping operations. In particular, the depressions which have developed at both sides of the rails during tamping of the sleepers are to be filled up with ballast in the process. Specifically, the ballast is moved upwards from the bedding shoulders to the rails by means of the ballast pick-up devices.

If the machine is employed behind a track tamping machine, the working speed must be adapted to the slow forward motion of the track tamping machine. In this case, the speed of a rigid plough blade is not sufficient to set the ballast into a dynamic upward motion. For this reason, for slow working runs, ballast pick-up devices in the prior art are equipped with a conveyor drive. According to EP 0 092 886 A1, for example, plough plates are set in an oscillating motion to convey the ballast upwards.

According to CH 550 282 A, a ballast pick-up device is equipped with a circulating conveyor chain or with conveyor belts in order to transport ballast upwards at a bedding shoulder. U.S. Pat. No. 4,707,935 A discloses a ballast plough having laterally arranged drums which, for conveying ballast, are set in rotation by means of a drive.

SUMMARY OF THE INVENTION

It is the object of the present invention to provide an improvement over the prior art for a machine of the type mentioned at the beginning and a corresponding method. In particular, a more flexible operability of the machine is to be achieved.

According to the invention, these objects are accomplished by way of a machine according to claim 1 and a method according to claim 13. Dependent claims indicate advantageous embodiments of the invention.

In this, the machine is designed in such a way that, at least in an inoperative position, the upper contours of the machine are arranged below a delimiting plane which slopes downward in the working direction and extends through a field of vision of a driver's cabin of a rail vehicle designed to be coupled to the machine at the rear end thereof. Thus, the machine can be employed as a leading wagon of the rail vehicle, wherein sufficient visibility from the driver's cabin to the track is ensured.

The machine is mobile as a leading wagon at least in the inoperative position on railway lines in standard operation (for example, transfer travel). During this, for example, the ballast conveying devices are locked in a position which is within a pre-defined clearance gauge. Even in an operative position, only individual components occasionally project beyond the delimiting plane, so that sufficient visibility from the driver's cabin forward is provided also in working operations which are characterized by a slow speed.

Ballast profiling and ballast distribution can then be carried out flexibly, independently of the sequence within a rail vehicle formation. This particularly provides the possibility to couple the machine in front of a track tamping machine and to use excess ballast from the bedding shoulders for lifting and tamping the track. In this manner, a separate supplying of ballast can be omitted in many cases, and thus ballast can be saved during track maintenance. Ballast discharged beforehand at the bedding shoulders can also be shifted onto the track with the machine according to the invention. It is no longer necessary to use a track maintenance machine for ballast management (Ballast Distribution System) operated separately of the track tamping machine.

In this, it is favourable if the delimiting plane and a reference plane, formed by wheel contact points of the on-track undercarriages, enclose an angle of between 3° and 10°, particularly between 5° and 8°. The free visibility onto the track is then sufficient for all cases of application, so that the machine can be employed everywhere.

A further development of the machine provides that the machine comprises a ballast distributing device above each rail of the track for distributing the ballast at both sides of each rail. With this, targeted ballasting of the track takes place in an advantageous way at the locations of subsequent tamping.

Additionally useful is a transverse conveyor belt for discharging the ballast laterally. The same is used, for example, if too much ballast is taken up from the bedding shoulders and a storage of the excess ballast next to the track is desired.

In a further improvement of the machine, the latter comprises a centrally arranged longitudinal conveyor belt to transport ballast from the ballast pick-up devices to a collecting hopper. This additional ballast transport device increases the adjustability of the ballast pick-up devices and simplifies the arrangement of the individual machine components below the delimiting plane.

Advantageously in this, a ballast silo is connected to the collecting hopper to intermediately store ballast, if needed. In this manner, an uneven distribution of ballast on a track to be treated can be equalized over a longer stretch without problems.

A further simplification of the machine superstructure provides that the longitudinal conveyor belt is pivotable by means of an adjustment drive from a working position into an inoperative position. With this measure, it is possible to employ in particular a larger collecting hopper or ballast silo. The longitudinal conveyor belt conveys the ballast into the collecting hopper only in the working position and, for the inoperative position, is lowered below the delimiting plane.

For simple machine control, it is advantageous if the respective ballast pick-up device is adjustable by means of a pivot drive about a pivot axis extending orthogonally to an associated bedding shoulder. To evade lateral obstacles, the ballast pick-up device is merely pivoted upwards about said pivot axis without changing a pre-defined bedding shoulder angle during profiling.

An advantageous embodiment of the invention provides that the respective ballast pick-up device comprises a screw conveyor. This ensures an effective conveying of the ballast independently of grain size and the degree of contamination of the track bed. On the one hand, kinetic energy is introduced by the screw conveyor into the ballast in order to loosen the same up. On the other hand, the screw conveyor and a plough blade adjoining the same serve as conveying device for the ballast.

In a simple embodiment it is further provided that the machine is designed without a motive drive of its own. This enables a particularly compact design without compromising the usability. It is merely necessary for the rail vehicle coupled at the end to muster a thrust for surmounting the driving resistance of the machine. Contrary to conventional ballast ploughs, the ballast pick-up devices of the present machine do not require any thrust due to the existing conveying drives.

For better operability of the machine, it is useful if a camera oriented in the working direction is arranged at the front end of the machine. Then, unimpeded visibility onto the track is ensured also during working operations by means of the camera images transmitted into the driver's cabin.

It is additionally advantageous if the machine comprises a machine control which is set up for data exchange with a control of the rail vehicle designed to be coupled up. This facilitates the arranging of the machine within a rail vehicle formation.

The method according to the invention provides that, as a leading wagon of a rail vehicle designed as a track maintenance machine, the machine picks up ballast located laterally of the track by means of the ballast pick-up devices and deposits the same in a central region of the track. With this, an effective method of ballast profiling and ballast distribution in the course of a track rehabilitation is created.

An advantageous further development is provided if the position of the respective ballast pick-up device is changed by means of a control of the track maintenance machine in order to evade obstacles situated next to the track. During this, it is also possible to use position data of obstacles stored in the track maintenance machine or recognized by means of detection devices.

For simple usage of the machine it is useful if, for transfer travel, the ballast pick-up devices and, optionally, a conveyor belt as well as a ballast distribution device are brought into an inoperative position by means of associated drives. In working operations, these components are operated in an adjustable working position, which optimizes the use of the machine.

BRIEF DESCRIPTION OF THE DRAWINGS

The invention will be described by way of example below with reference to the attached figures. There is shown in schematic representation in.

DESCRIPTION OF THE EMBODIMENTS

Figure 1:
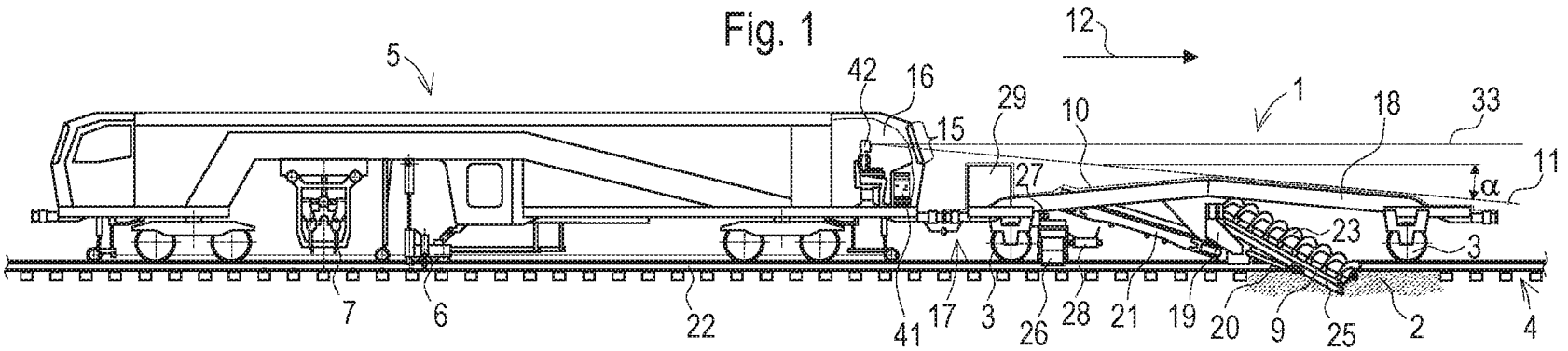
FIG. 1 a machine as leading vehicle of a track tamping machine

The machine 1, shown in FIG. 1, for profiling and distributing ballast 2 is mobile on a track 4 by means of on-track undercarriages 3. As an example, the machine 1 is coupled as a leading vehicle to a rail vehicle 5 designed as a track tamping machine (line tamping machine or universal tamping machine). The track tamping machine comprises a lifting-/lining unit 6 for lifting and lining the track 4, whereby a pre-defined track position is produced. For fixating said track position, the track 4 is tamped with a tamping unit 7.

Coupling in front of other track maintenance machines (for example, Dynamic Track Stabilizer) or regular traction vehicles (for transfer travel) may also be useful.

Often, excess ballast 2 is present at bedding shoulders 8, or additional ballast 2 is deposited there. By means of the present machine 1, said ballast 2 is picked up and discharged at the locations in the track 4 to be tamped. To that end, the machine 1 comprises a respective ballast pick-up device 9 at either side.

In this, the superstructure of the machine 1 is configured such that the upper contours 10—at least in an inoperative position of the machine 1—are arranged below a delimiting plane 11. In the example of embodiment according to FIG. 1, this is the case even during working operations when the ballast pick-up devices 9 are pivoted out laterally into a working position. In the inoperative position, the machine 1 is mobile unrestrictedly on railway lines in standard operation, wherein it is coupled as lead vehicle to a rail vehicle 5 arranged behind the same.

The delimiting plane 11 slopes downward in a working direction 12 at an angle $\alpha$ of approximately 5° to 8° with respect to a reference plane 14 formed by wheel contact points 13 of the on-track undercarriages 3, wherein the delimiting plane 11 extends through a visibility area 15 of a driver's cabin 16 of the coupled rail vehicle 5. This means that above the rear end 17 of the machine 1, the delimiting plane 11 extends mostly at a height of about 2.5 m to 3.0 m with respect to the reference plane 14 formed by the wheel contact points 13 of the on-track undercarriages 3.

The supporting component of the machine 1 is a frame 18 which is formed, for example, from welded-together steel form tubes and is supported on the on-track undercarriages 3. On said frame 18, the ballast pick-up devices 9 are adjustably fastened at either side via suspension devices 19 and adjustment drives 20. In the embodiment, the ballast pick-up devices 9 convey the ballast 2 onto a centrally arranged longitudinal conveyor belt 21. In a simpler embodiment, the ballast pick-up devices 9 discharge the ballast 2 in the region of the rails 22 directly onto the track 4, or the respective ballast pick-up device 9 conveys the ballast 2 upward via a separate longitudinal conveyor belt.

The particular depicted ballast pick-up device 9 comprises a screw conveyor 23 which is set in rotation by means of a conveyor drive 24 and transports the ballast 2 upward along a channel-shaped plough shield 25. Alternatively, other ballast pick-up devices 9 with conveyor drive 24 could also be used, for example conveying chains, vibration drives, etc.

In the embodiment, a separate ballast distributing device 26 is associated with each rail 22, wherein the ballast is supplied by means of the longitudinal conveyor belt 21 or, in a simplified variant, directly by means of the ballast pick-up devices 9. The respective ballast distributing device 26 has discharge openings which are adjustable via drives, wherein the opening width set in each case regulates the ballast discharge. In this manner, an adjustable ballast quantity is deposited on the track 4 at both sides of each rail 22. In an alternative design, a conveyor belt pivotable about an approximately vertical axis is provided as ballast distributing device 26. A free end of the conveyor belt is pivoted to and fro during working operations and discharges the ballast 2 at both sides of the rails 22.

By means of a deflecting device 27, the ballast 2 can be deflected onto a transverse conveyor belt 28. With this, it is possible to deposit the ballast 2, picked up from the bedding shoulder 8, at a desired location laterally next to the track 4. In this, the running direction of the transverse conveyor belt 28 determines the side of depositing. Additionally, by way of transverse adjustability of the transverse conveyor belt 28 or a variable belt speed, it is possible to vary the distance of the discharge point from the rails 22.

For supplying the powered devices 9, 21, 26, 28, an energy module 29 is preferably arranged on the machine 2. This is, for example, a combustion engine with a generator and/or a hydraulic pump. A fuel tank 30 is optionally arranged in the front region at the underside of the frame 18 without affecting the upper contours 10 of the machine 1. A further drive variant is an electrically supplied hydraulic unit (Hydraulic Powerpack) which is arranged on the machine, wherein an accumulator may be provided as an energy buffer. The ballast pick-up devices 9, conveyor belts 21, 28 and other devices are powered electrically or hydraulically. In this, a supplying by means of the coupled rail vehicle 5 is also possible.

Figure 3:
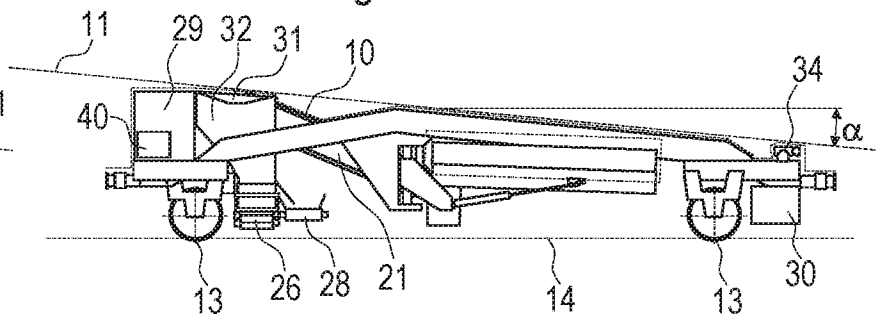
FIG. 3 machine in the inoperative position
Figure 2:
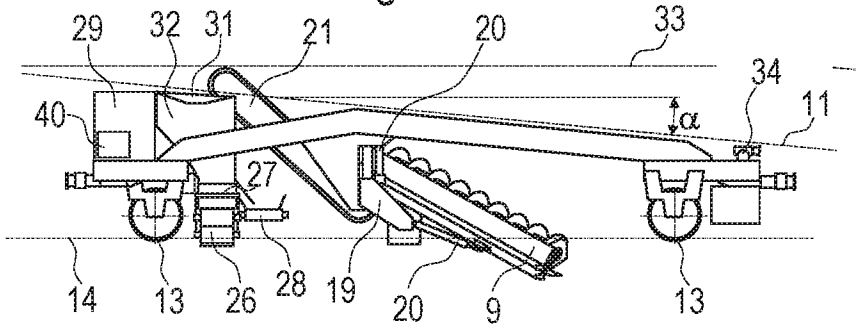
FIG. 2 machine in the working position

FIGS. 2 and 3 show another embodiment of the machine 1 in a working position and in an inoperative position. The longitudinal conveyor belt 21 is here designed to be vertically adjustable in order to convey the ballast 2 during working operations into a collecting hopper 31 to which a ballast silo 32 is connected. The intermediate storage in the ballast silo 32 allows a better distribution of the ballast 2 over a longer stretch of track.

The ballast 2 is selectively deposited from the ballast silo 32 via ballast distributing devices 26 at both sides of each rail 22 or via a transverse conveyor belt 28 laterally of the track 4, as desired. The ballast pick-up devices 9 as well as the ballast distributing devices 26 and the longitudinal conveyor belt 21 can be transferred into an inoperative position by means of drives 20, as shown in FIG. 3.

In this, the longitudinal conveyor belt 21 is lowered so far that the contours 10 extend below the delimiting plane 11. However, even during working operations, the longitudinal conveyor belt 21 projects only insignificantly beyond the delimiting plane 11, so that at least a straight vision 33 forward from the driver's cabin 16 is still possible without restriction. With this forward vision, working travel at slow speed is possible without problem.

In an extended embodiment, a camera 34 is arranged at the front end of the machine 1, the images of which are displayed in real time in the driver's cabin 16. With this, an additional safety device for working operations is provided.

Figure 4:
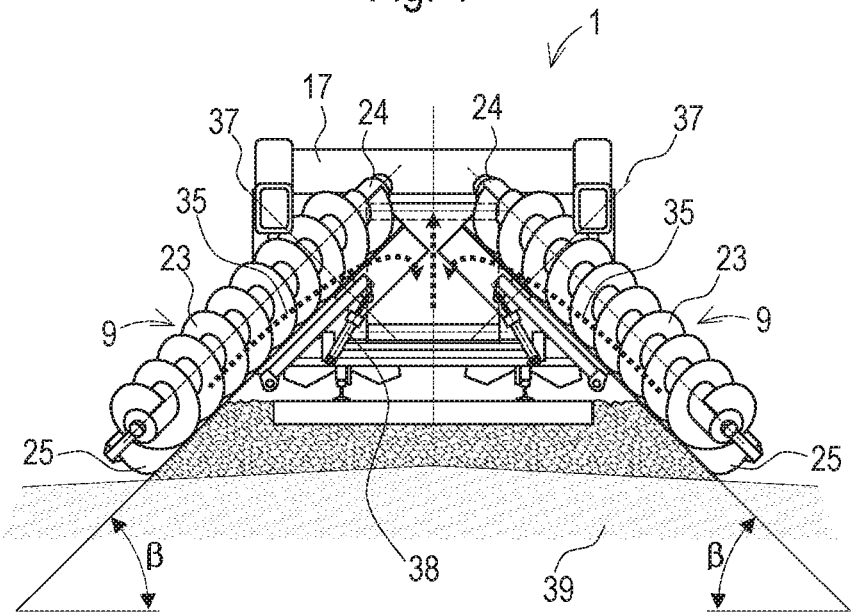
FIG. 4 cross-section of the machine with ballast pick-up devices shown
Figure 5:
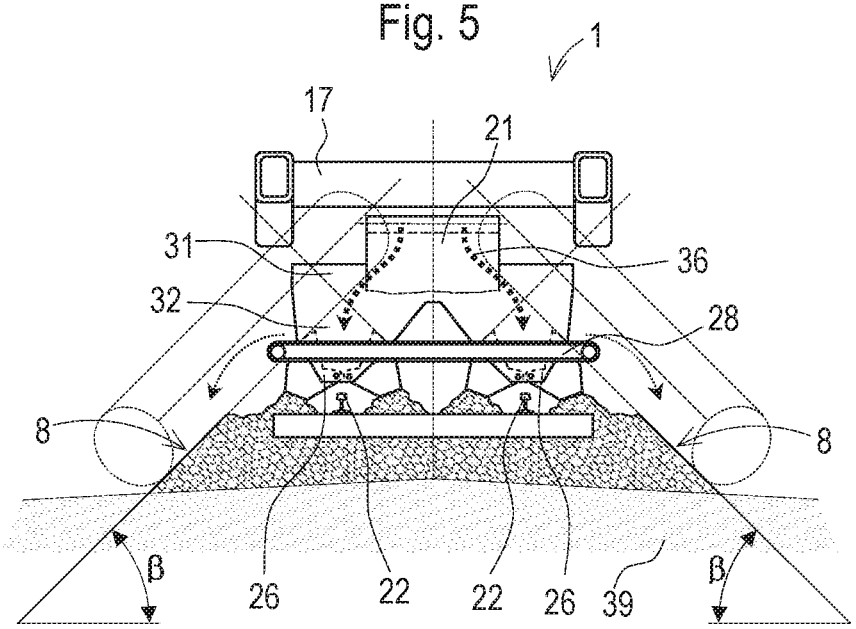
FIG. 5 cross-section of the machine with ballast pick-up devices and transverse conveyor belt shown

In FIGS. 4 and 5, cross-sections of the machine 1 are shown. FIG. 4 shows the ballast flow 35, caused by the ballast pick-up devices 9 and running essentially up, from the bedding shoulders 8 upwards to a lower end of the longitudinal conveyor belt 21. The latter conveys the ballast 2 rearward to the collecting hopper 31.

FIG. 5 shows the further ballast flow 36, running essentially downward, from the upper end of the longitudinal conveyor belt 21 via the collecting hopper 31 and optionally the ballast silo 32 to the ballast distributing devices 26. During this, the ballast flow can be deflected partially or totally to the transverse conveyor belt 28 by means of a deflection device 27 and discharged next to the track 4.

In order to evade obstacles present next to the track 4, each ballast pick-up device 9 is pivotable about a pivot axis 37 by means of a pivot drive 38. In this, the pivot axis 37 is adjusted prior to the start of work in order to profile the associated bedding shoulder 8 at a pre-defined bedding shoulder angle β. Specifically, the pivot axis 37 is oriented orthogonally to the associated bedding shoulder 8 by means of auxiliary drives. Thus, during pivoting about the pivot axis 37, the set bedding shoulder angle β is retained, which provides a simple control for evading obstacles. As a result, the ballast pick-up devices 9 are guided precisely above a formation protection layer 39 located under the ballast bed.

The machine 1 is preferably controlled from the driver's cabin 16 of the coupled rail vehicle 5. To that end, the machine 1 comprises a machine control 40 which is designed for data exchange with a control 41 of the rail vehicle 5. In this, an operator 42 in the driver's cabin 16 can initiate control commands and carry out adjustments on the machine 1. Automated ballast distribution can also be provided.

The invention claimed is:

1. A machine for profiling and distributing ballast of a track, comprising:
- a frame;
- a plurality of on-track undercarriages;
- wherein the frame is supported on on-track undercarriages
- a conveyor drive;
- lateral ballast pick-up devices adjustably fastened to the frame, wherein each ballast pick-up device is actuated by said conveyor drive, wherein the machine is designed in such a way that, in an inoperative position, the upper contours of the machine are arranged below a delimiting plane which slopes downward in the working direction and extends through a field of vision of a driver's cabin of a rail vehicle designed to be coupled to the machine at the rear end thereof;
- wherein the respective ballast pick-up device is adjustable by means of a pivot drive about a pivot axis extending orthogonally to an associated bedding shoulder in order to retain a set bedding shoulder angle during pivoting said pick up device about the pivot axis;
- wherein the respective ballast pick-up device comprises a screw conveyor; and
- a longitudinal conveyor belt configured to receive ballast from said lateral ballast pick up devices;
- at least one hopper configured to receive ballast from said lateral ballast pick up devices;
- at least one transverse conveyor belt extending transverse to said longitudinal conveyor belt and disposed beneath said hopper and configured to receive ballast from said at least one hopper.

2. The machine according to claim 1, wherein the delimiting plane and a reference plane, formed by wheel contact points of the on-track undercarriages, enclose an angle (α) of between 3° and 10°, particularly between 5° and 8°.

3. The machine according to claim 1, wherein a ballast silo is connected to the hopper.

4. The machine according to claim 1, wherein the longitudinal conveyor belt is pivotable by means of an adjustment drive from a working position into the inoperative position.

5. The machine according to claim 1, wherein the machine is designed without a motive drive.

6. The machine according to claim 1, wherein a camera oriented in the working direction is arranged at the front end of the machine.

7. The machine according to claim 1, wherein the machine comprises a machine control which is set up for data exchange with a control of the rail vehicle designed to be coupled up.

8. A method for profiling and distributing ballast of a track by means of a machine according to claim 1, wherein, as a leading vehicle of a rail vehicle designed as a track maintenance machine, the machine picks up ballast located laterally of the track by means of the ballast pick-up devices and deposits the same in a central region of the track.

9. The method according to claim 8, wherein the position of the respective ballast pick-up device is changed by means of a control of the track maintenance machine in order to evade obstacles situated next to the track.

10. The method according to claim 8, wherein for transfer travel, the ballast pick-up devices and, optionally, a conveyor belt as well as a ballast distribution device are brought into an inoperative position by means of associated drives.

11. A machine for profiling and distributing ballast of a track, comprising:

a frame;

a plurality of on-track undercarriages;

wherein the frame is supported on on-track undercarriages a conveyor drive;

lateral ballast pick-up devices adjustably fastened to the frame, wherein each ballast pick-up device is actuated by said conveyor drive, wherein the machine is designed in such a way that, in an inoperative position, the upper contours of the machine are arranged below a delimiting plane which slopes downward in the working direction and extends through a field of vision of a driver's cabin of a rail vehicle designed to be coupled to the machine at the rear end thereof;

wherein the respective ballast pick-up device is adjustable by means of a pivot drive about a pivot axis extending orthogonally to an associated bedding shoulder in order to retain a set bedding shoulder angle during pivoting said pick up device about the pivot axis;

wherein the respective ballast pick-up device comprises a screw conveyor; and a longitudinal conveyor belt configured to receive ballast from said lateral ballast pick up devices;

at least one transverse conveyor belt extending transverse to said longitudinal conveyor belt and configured to receive ballast from said longitudinal conveyor belt and distribute the ballast to the track.

* * * * *